US006799727B2

(12) United States Patent
Webster et al.

(10) Patent No.: US 6,799,727 B2
(45) Date of Patent: Oct. 5, 2004

(54) FLAME-EFFECT HEATING APPARATUS

(75) Inventors: Gary Stanton Webster, Bicknacre (GB); Jeremy James Stanley, Basildon (GB)

(73) Assignee: Smith's Environmental Products Limited (GB)

( * ) Notice: Subject to any disclaimer, the term of this patent is extended or adjusted under 35 U.S.C. 154(b) by 163 days.

(21) Appl. No.: 10/006,690

(22) Filed: Nov. 2, 2001

(65) Prior Publication Data

US 2002/0175215 A1 Nov. 28, 2002

(30) Foreign Application Priority Data

May 1, 2001 (GB) ..... 0110644

(51) Int. Cl.[7] ..... F24F 7/00

(52) U.S. Cl. ..... 237/49; 431/125; 431/126; 237/46

(58) Field of Search ..... 237/49, 46; 431/125, 431/126

(56) References Cited

U.S. PATENT DOCUMENTS 1,867,740 A * 7/1932 Guy ..... 392/348
3,742,189 A * 6/1973 Conroy et al. ..... 392/348
4,061,133 A * 12/1977 Swain ..... 126/514
4,573,905 A * 3/1986 Meyers ..... 431/125
4,890,600 A * 1/1990 Meyers ..... 126/512
4,965,707 A * 10/1990 Butterfield ..... 362/96
6,155,837 A * 12/2000 Korneliussen ..... 434/226

* cited by examiner

*Primary Examiner*—Derek Boles
(74) *Attorney, Agent, or Firm*—Renner, Kenner, Greive, Bobak, Taylor & Weber

(57) ABSTRACT

Flame-effect heating apparatus comprises a housing with walls defining an air duct extending therethrough. Simulated fuel is supported by the housing, externally of the duct, and at least one flame-effect generator is disposed in the duct. A light source is provided in the housing to illuminate both the simulated fuel and the flame-effect generator. A mirror is supported by the housing so that light reflected by the flame-effect generator is incident thereon. A wall of the housing which defines the air duct, is formed as a viewing screen on which light reflected by the mirror falls, the viewing screen being positioned higher than the simulated fuel. An electric fan causes air to flow through the air duct, so causing operation of the flame-effect generator, and a heat exchanger disposed in the duct warms air passing thereover.

18 Claims, 5 Drawing Sheets

FLAME-EFFECT HEATING APPARATUS

BACKGROUND TO THE INVENTION (a) Field of the Invention

The present invention relates to flame-effect heating apparatus. In particular it relates to flame-effect heating apparatus which is adapted for connection to a domestic water heating system.

(b) Description of the Prior Art

It has long been thought desirable to combine the aesthetically appealing qualities of a burning solid fuel fire, with the convenience and efficiency of an electric heater. Over the years, so-called "flame-effect" systems have been incorporated into a wide range of electric heating appliances, such as radiant, convector and fan-assisted heaters.

The flame-effect is often achieved by a combination of the reflection of light onto a screen, and the creation of a flickering effect by means of a spinner mounted above the light source. Alternatively, or additionally, moveable ribbons may be used to reflect light onto the screen. In use, the ribbons are blown by a fan, and the resultant random motion thus adds to the realism of the flame-effect.

However, despite the widespread use of flame-effect systems in conventional electric heaters, until now no such system has been satisfactorily incorporated into a so-called "hydronic" heater. The term "hydronic" is used herein to refer to heating apparatus which heats air by causing it to flow over a heat exchanger, through which is passed a heated liquid. For the purposes of domestic heating, the liquid is normally water, with the heat exchanger being in liquid communication with a domestic water heating system.

SUMMARY OF THE INVENTION

The present invention provides flame-effect hydronic heating apparatus, which also incorporates improvements to existing flame simulation techniques.

According to the present invention, there is provided heating apparatus comprising:

- a housing having walls which define an air duct extending through said housing;
- simulated fuel supported by the housing, external of the air duct;
- flame simulation means comprising at least one flame-effect generator disposed in the air duct, a light source supported by the housing to illuminate both said simulated fuel and said at least one flame-effect generator, a mirror supported by the housing so that light from said light source and reflected by said at least one flame-effect generator is incident thereon, a wall of said housing defining the air duct being formed as a viewing screen on which light reflected by said mirror falls, the viewing screen being positioned at a higher level than said simulated fuel;
- an electrically-driven fan disposed to cause air to flow through the air duct, so causing operation of said at least one flame-effect generator; and
- a heat exchanger disposed in said air duct so as to cause air passing thereover to be warmed.

The term "flame-effect generator" as used herein includes any flexible material capable of reflecting or obstructing light so as to produce simulated flames on the screen. The flexible material may be in the form of one or more ribbons or strips of lightweight fabric, metallised foil or other suitable material. Such ribbons or strips may be tethered at their upper and/or lower ends.

BRIEF DESCRIPTION OF THE DRAWINGS

Preferred embodiments of the present invention will now be described, by way of example only, with reference to the accompanying drawings, in which.

DESCRIPTION OF THE PREFERRED EMBODIMENTS

Figure 1:
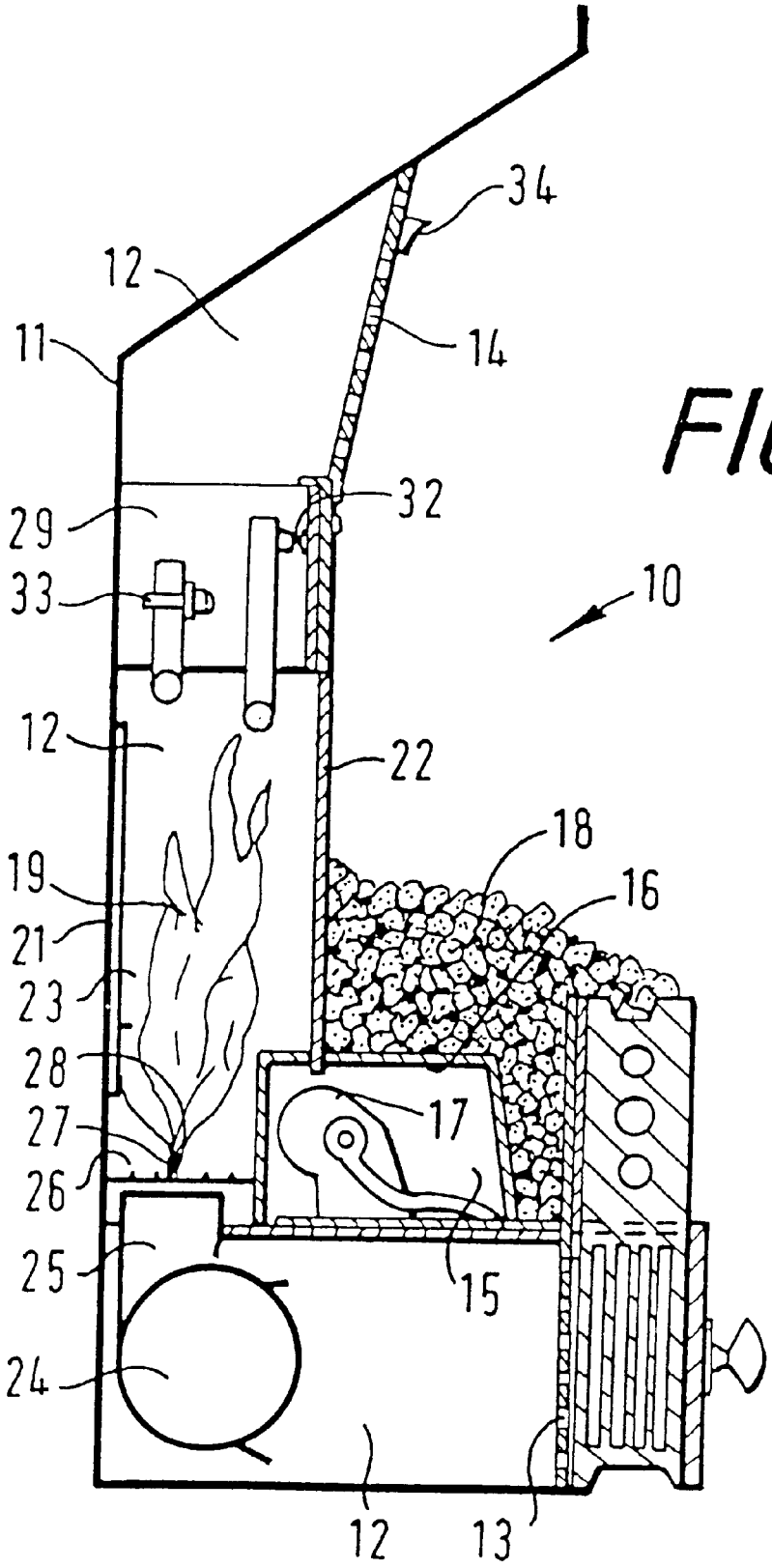
FIG. 1 is a cross-sectional view of flame-effect hydronic heating apparatus according to the present invention.

In a preferred embodiment of the present invention, there is more than one flame-effect generator, each of which is formed from a piece of lightweight, flexible fabric having an upwardly-tapering profile so as generally to imitate the shape of a flame. The pieces of light weight flexible fabric preferably have a reflective finish, and advantageously are of silk.

In order to facilitate the random movement of the flame-effect generators in the air duct, it is preferred that they be tethered at their lower ends only to a grille provided in the air duct above the electrically-driven fan. The upper ends are thus able to move freely in the air-stream. The grille prevents the generators from falling into the fan when said fan is switched off.

For convenience, the flame effect generators may be removably attached to the grille, preferably by the provision of co-operating magnetic attachment means on both the generators and the grille. Alternatively a Velcro®-type hook and loop fastener arrangement may be used.

The air duct preferably extends from an air inlet located at a lower front part of the housing, to an air outlet located at an upper front part of the housing, with a forward-facing wall of the housing forming part of the air duct and serving as the viewing screen.

Preferably, a single electrically-driven fan is used both to cause operation of the flame-effect generators and to direct air over the heat exchanger. By contrast, conventional non-hydronic electric heaters incorporating similar flame-effect systems usually employ a first fan to operate the flame-effect generators and a second fan to pass air over the heating element.

In preferred embodiments, the electrically-driven fan is disposed in the air duct adjacent to the air inlet, the heat exchanger is disposed adjacent to the air outlet, and the flame-effect generators are disposed therebetween. It is currently most preferred that the fan be disposed at the bottom of a flame-effect chamber defined within a substantially vertical portion of the air duct, the nozzle of the fan being directed upwards into said chamber. When the apparatus is in use, air is drawn in through the inlet by the fan, turned through substantially 90°, and blown up through the flame-effect chamber and over the heat exchanger, before exiting through the outlet.

The heat exchanger preferably has connectors to permit the liquid communication thereof with a domestic water heating system, when installed.

In preferred embodiments of the present invention, the apparatus is provided with control means, arranged automatically to switch on both the electrically-driven fan and the electrically-driven light source upon activation of the water heating system. Preferably, the control means comprises a thermostat, such that the fan and light source are activated when the water in the heating system is heated to a pre-selected temperature. It is currently preferred that this activation temperature should be substantially 47° C.

The control means may desirably also permit the electrically-driven fan and the light source to be switched on independently of the temperature of water in the water heating system. In this way the present invention may be used to simulate the visual appearance of a burning solid fuel fire, even when no heating is required.

In a most preferred embodiment of the present invention, the control means is adapted to operate the electrically-driven fan at two or more pre-selected speeds. Operating the fan at a higher speed, increases the flow of air over the heat exchanger, thus leading to an increase in the heat given out by the heating apparatus. Additionally, the flame-effect generators are caused to move faster, and the resultant reflections increase the flickering of the simulated flames. This creates the illusion that the increased heat output results from the intensified flame-effect, thus enhancing the realism of the flame-effect.

In currently preferred embodiments of the present invention, the viewing screen has a forward-facing surface which is generally non-reflective and a rearwardly-directed surface which is generally diffusing. In order that the flame-effect generators may easily be removed for cleaning, it is preferred that the viewing screen is hingedly and/or removably mounted on the housing, thus enabling access to the air duct.

Similarly, in a preferred embodiment, the light source comprises a fitting for a light bulb, said fitting being mounted on a removable portion of the housing, to enable replacement of the light bulb.

A particular embodiment of the heating apparatus of this invention will now be described with reference to accompanying FIGS. 1 to 5.

Referring initially to FIG. 1, there is shown heating apparatus, generally indicated 10, having a housing 11, within which is defined an air duct 12. The air duct 12 extends from an inlet 13, located at a lower front part of the housing 11, to an air outlet 14, located at an upper front part of the housing 11.

A cavity 15 is defined externally of the air duct 12, by a transparent or translucent portion 16 of the housing 11. A light source 17 located within the cavity 15, is disposed so as to illuminate both simulated fuel 18, and also flame-effect generators 19, located in the air duct 12. The flame-effect generators 19 are formed from pieces of silk having a flame-shaped profile. The simulated fuel 18 is supported by the transparent or translucent portion 16 of the housing 11.

A mirror 21 provided on a rear wall of the air duct 12, is disposed to reflect light from the light source 17 and the flame-effect generators 19, onto a viewing screen 22 which, together with a rear wall of the housing 11, defines a flame-effect chamber 23 in the air duct 12.

An electrically-driven fan 24 having a nozzle 25 is located in the air duct 12, and is arranged such that said nozzle 25 is directed upwards towards the flame-effect chamber 23. Mounted immediately above the fan 24 is a grille 26, which extends across the air duct 12, and has a peg 27 upstanding therefrom. The flame-effect generators 19 have a lower end 28 which is removably attached to the upstanding peg 27, by co-operating magnetic attachment means provided thereon. Alternatively, the upstanding peg 27 and the lower end 28 of the flame-effect generators 19 may each be provided with co-operating hook and loop fasteners, such as those sold under the trade mark Velcro®.

Figure 5:
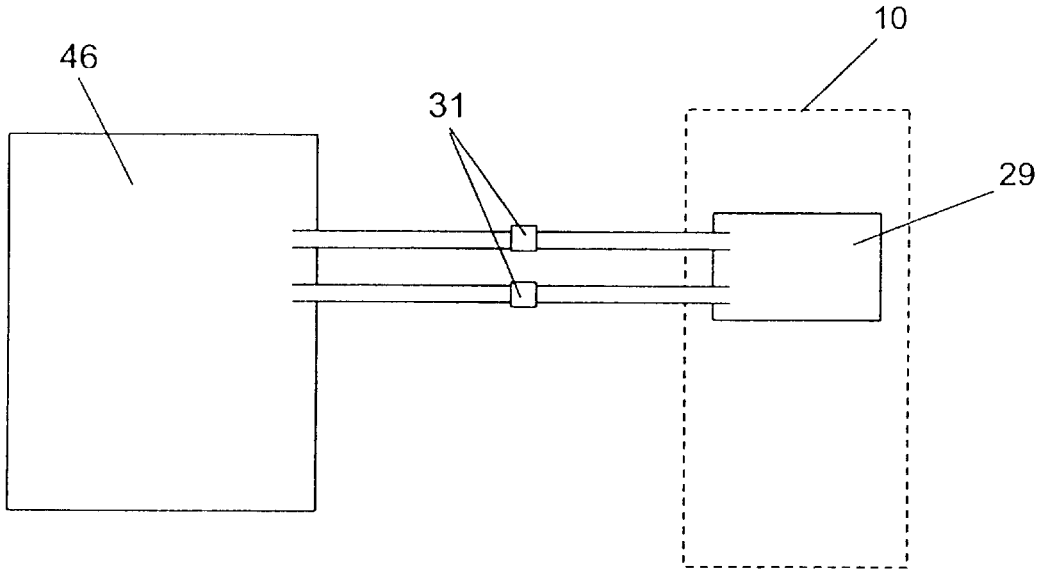
FIG. 5 is a schematic diagram showing the connection of the heating apparatus to a domestic water heating system.

Extending across an upper portion of the flame-effect chamber 23 of the air duct 12 is a heat exchanger 29. The heat exchanger 29 is provided with an air bleeding valve 32 and thermostatic control means 33, which control means are operatively linked with the fan 24, the light source 17, and a control switch 34 located externally on the housing 11. The heat exchanger 29 is also provided with connectors 31 to permit the linking thereof with a domestic water heating system 46, as shown in FIG. 5. Extending across an upper portion of the flame-effect chamber 23 of the air duct 12 is a heat exchanger 29. The heat exchanger 29 is provided with an air bleeding valve 32 and thermostatic control means 33, which control means are operatively linked with the fan 24, the light source 17, and a control switch 34 located externally on the housing 11. The heat exchanger 29 is also provided with connectors 31 to permit the linking thereof with a domestic water heating system 46, as shown in FIG. 5.

Figure 2:
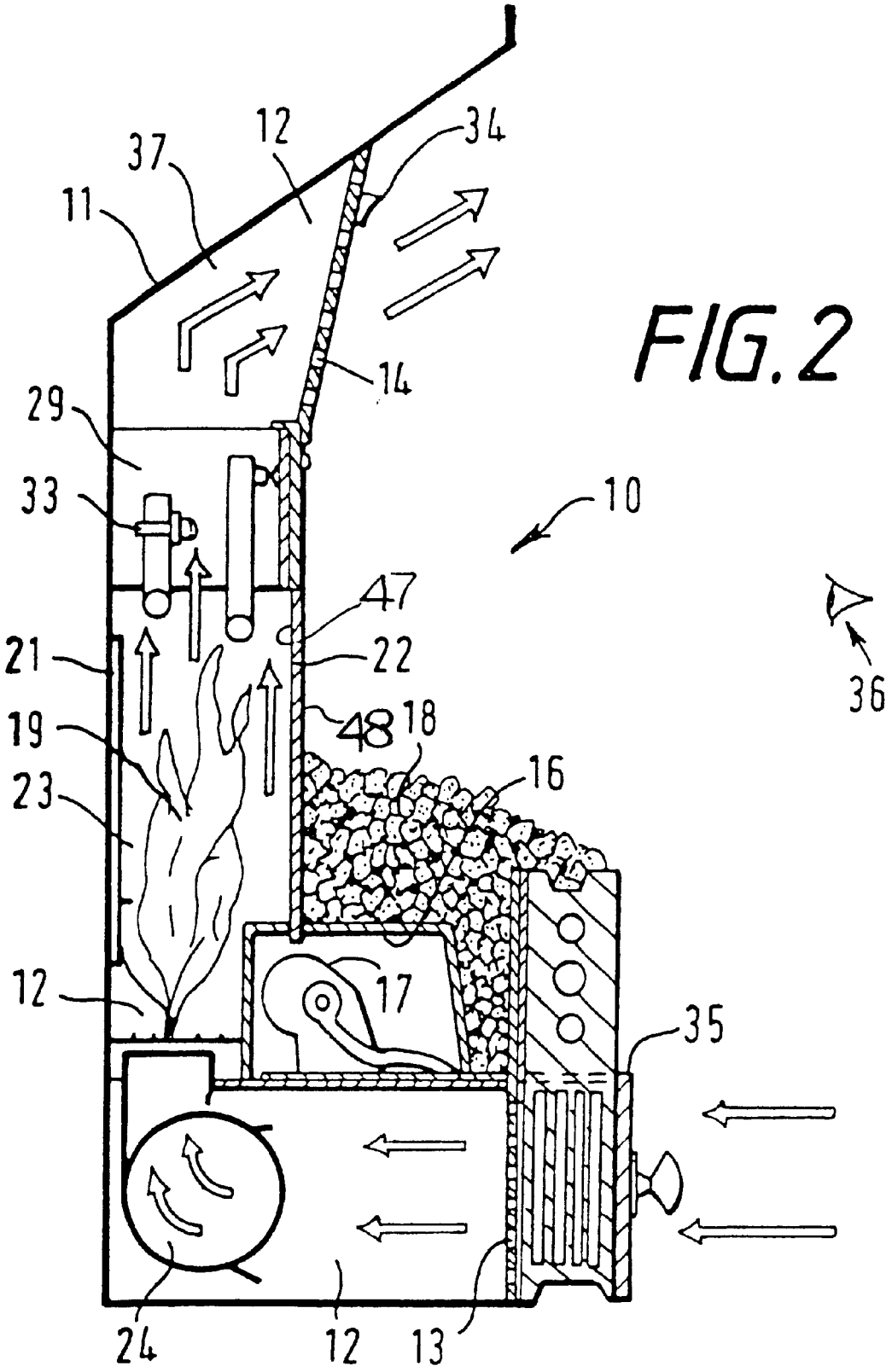
FIG. 2 shows the heating apparatus of FIG. 1, with a diagrammatic representation of airflow therethrough when the apparatus is in use.

During use of the heating apparatus, as shown in FIG. 2, when the temperature of the water in the heat exchanger 29 reaches a pre-selected temperature, the fan 24 and the light source 17 are switched on automatically by the thermostatic control means 33. The fan 24 draws air from the ambient into the air duct 12, through the air inlet 13 located at a lower front part of the housing 11. A decorative facia 35 may be mounted on the front part of the housing 11. As the air is drawn through the electrically-driven fan 24, the direction of the air flow (indicated by the arrows) is turned through substantially 90°, and the air is then blown upwards through the flame-effect chamber 23, causing motion of the flame-effect generators 19.

At the same time, the light source 17 illuminates the flame-effect generators 19 and the simulated fuel 18 through the transparent or translucent portion 16 of the housing 11. Light from the light source 17 and the flame-effect generators 19 is reflected by the mirror 21 onto the viewing screen 22 which is light-diffusing at its rear surface 47, and non-reflective at its forward facing surface 48. An observer, generally indicated at 36, therefore sees a diffuse image of simulated flames dancing randomly on a portion of the viewing screen 22 immediately above the simulated fuel 18.

The fan 24 drives the air past the flame-effect generators 19, and on to the heat exchanger 29. The air is heated as it passes over the heat exchanger 29. The direction of the air flow is then turned again through substantially 35° by a sloping cowl 37 at the end of the air duct 12 adjacent to the outlet 14. The heated air is then returned to the ambient through the outlet 14, immediately above the simulated flames on the viewing screen 22, and the simulated fuel 18. The observer 36 thus experiences the illusion that the heat is emanating from the simulated flames on the viewing screen 22.

Alternatively, the control switch 34 may be used to override the thermostatic control means 33 such that the heating apparatus 10 operates in "flame-effect only" mode. In this mode of operation, the electrically-driven fan 24 and the light source 17 are switched on, thus providing the simulated flames on the viewing screen 22, but no heating of air occurs due to inactivity of the water heating system.

The control switch 34 may also be used when the heating apparatus 10 is operating in its normal heating mode, to vary the speed of rotation of the electrically-driven fan 24. By causing the fan 24 to operate at a higher speed, the flow of air over the flame-effect generators 19 and the heat exchanger 29 is increased. Consequently, the simulated flames on the viewing screen 22 appear to move quicker, whilst a greater amount of heat is emitted through the outlet 14. For the observer 36, this adds to the realism of the illusion that the heat emanates from the simulated flames.

Figure 3:
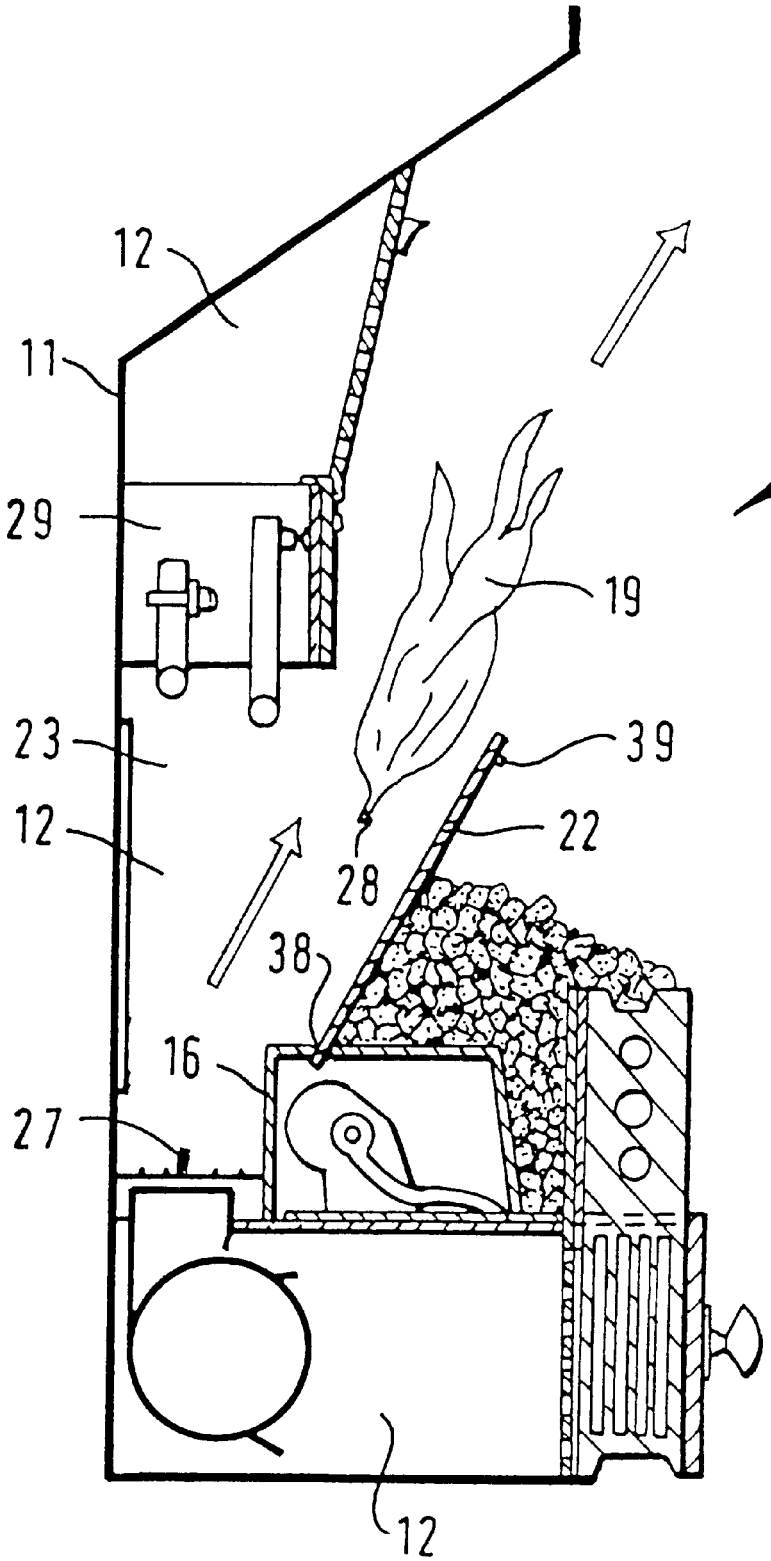
FIG. 3 shows a preferred embodiment of the heating apparatus of FIGS. 1 and 2, having its viewing screen hingedly mounted to enable access to the air duct.

Referring now to FIG. 3, it will be seen that the viewing screen 22 is mounted by a hinge 38 at its lower end, to the transparent or translucent portion 16 of the housing 11. The upper end of the viewing screen 22 is releasably attached to a portion of the housing 11 in front of the heat exchanger 29, by means of a catch 39.

The screen 22 can thus be detached from the housing 11 at its upper end by means of the catch 39, and hinged forwards about hinge 38, in order that access may be gained to the flame-effect chamber 23. The flame-effect generators 19 may thus be removed by detaching the lower end 28 thereof from the upstanding peg 27.

Figure 4:
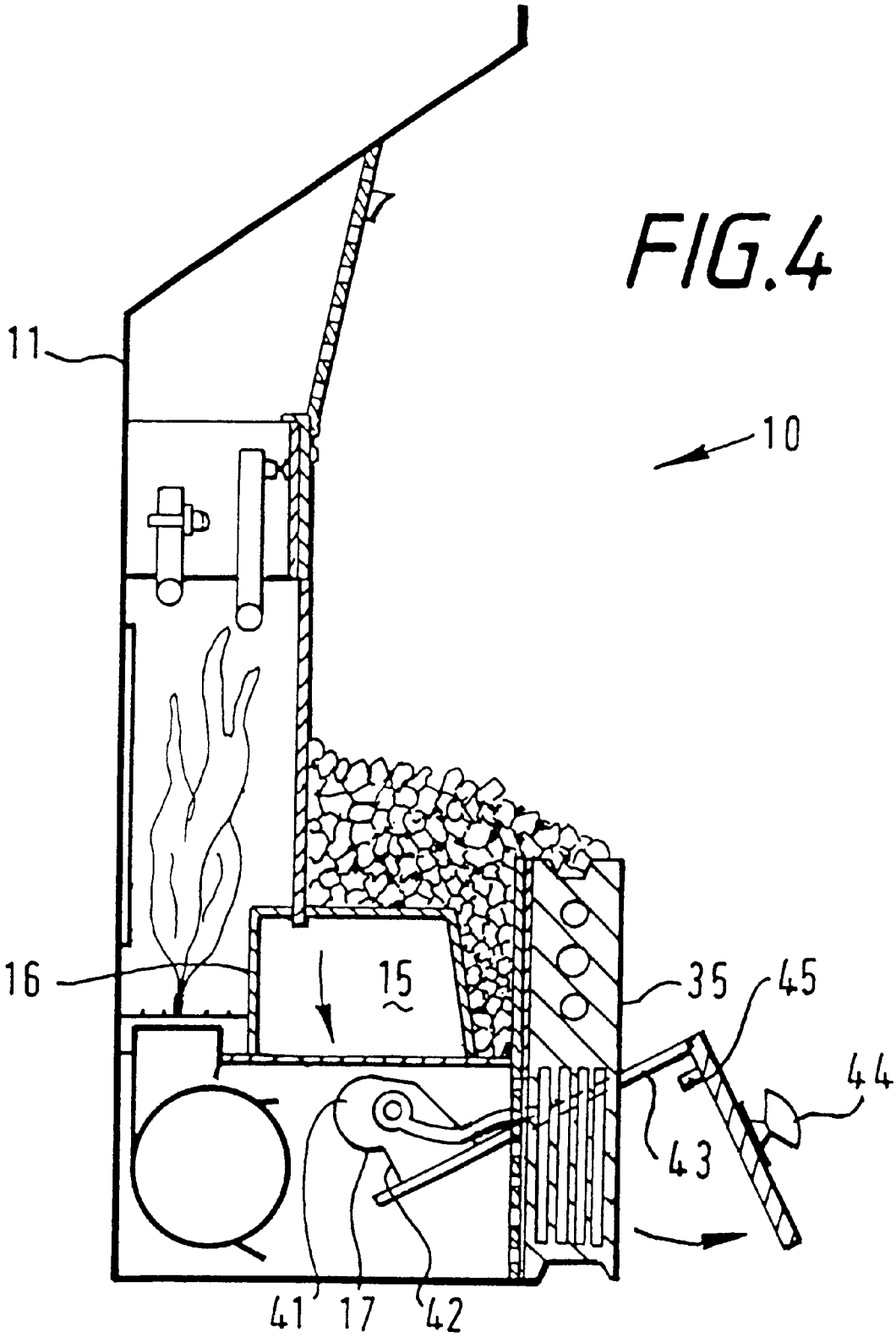
FIG. 4 shows a preferred embodiment of the heating apparatus of FIGS. 1 and 2, having its light source mounted on a removable portion of the housing to enable replacement of a light bulb.

Referring now to FIG. 4, in this embodiment of heating apparatus 10, the light source 17 comprises a light bulb 41, and a fitting 42 for said light bulb 41. The fitting 42 is mounted on a removable portion 43 of the housing 11. The front of this removable portion 43 forms part of the decorative facia 35, and has a handle 44. The removable portion 43 is normally held in place on the main part of the housing 11 by a retaining tab 45 which engages with a complementary slot (not shown) in the housing 11. The light source 17 is thus normally held in place in the cavity 15. When the light bulb 41 is to be changed, the removable portion 43 may be withdrawn from the main part of the housing 11 by pulling handle 44 forwards and upwards, until the removable portion 43 is clear of the housing 11.

What is claimed is:

1. Heating apparatus comprising:

a housing having walls which define an air duct extending through said housing, an air inlet located at a lower front part of the housing, and an air outlet located at an, upper front part of the housing, said air duct extending from the air inlet to the air outlet;

simulated fuel supported by the housing, external of the duct;

an electrically-driven fan disposed in the air duct adjacent to the air inlet to cause air to flow through said air duct;

a heat exchanger disposed in said air duct adjacent to the air outlet so as to cause air passing thereover to be warmed; and flame simulation means comprising at least one flame-effect generator disposed in the air duct between the electrically-driven fan and the heat exchanger, so that air flowing through the air duct causes operation of said at least one flame effect generator, a light source supported by the housing to illuminate both said simulated fuel and said at least one flame-effect generator, a mirror supported by the housing so that light from said light source and reflected by said at least one flame-effect generator is incident thereon, and a forward-facing wall of said housing defining the air duct being formed as a viewing screen on which light reflected by said mirror falls, the viewing screen being positioned at a higher level than said simulated fuel.

2. Heating apparatus according to claim 1, wherein a single electrically-driven fan is disposed in the air duct so as to direct air over said at least one flame-effect generator, to cause operation thereof, and over the heat exchanger.

3. Heating apparatus according to claim 1, wherein the heat exchanger has connectors to permit the liquid communication thereof with a domestic water heating system.

4. Heating apparatus according to claim 3, further comprising control means arranged automatically to switch on both the electrically-driven fan and the light source upon activation of the domestic water heating system.

5. Heating apparatus according to claim 4, wherein the control means comprises a thermostat arranged automatically to switch on the electrically-driven fan and the light source, upon water in the domestic water heating system being heated to a pre-selected temperature.

6. Heating apparatus according to claim 5, wherein the control means is arranged automatically to switch on the electrically-driven fan and the light source, upon water heating system being heated to substantially 47° C.

7. Heating apparatus according to claim 4, wherein the control means is arranged to permit operation of the electrically-driven fan and the light source, independently of the temperature of water in the domestic water heating system.

8. Heating apparatus according to claim 4, wherein the control means is adapted to operate the electrically-driven fan at two or more pre-selected speeds.

9. Heating apparatus according to claim 1, wherein said at least one flame-effect generator comprises a flexible reflective fabric having a lower end, and an upwardly-tapering profile so as generally to imitate the shape of a flame.

10. Heating apparatus according to claim 9, wherein the flexible reflective fabric is silk.

11. Heating apparatus according to claim 9, wherein the fabric of said at least one flame-effect generator is tethered only at the lower end thereof to a grille provided in the air duct.

12. Heating apparatus according to claim 11, wherein said at least one flame-effect generator is removably attached to the grille.

13. Heating apparatus according to claim 12, wherein said at least one flame-effect generator and the grille are provided with co-operating magnetic attachment means.

14. Heating apparatus according to claim 12, wherein said at least one flame-effect generator and the grille are provided with co-operating hook and loop fasteners.

15. Heating apparatus according to claim 12, wherein the viewing screen is removably mounted on the housing, such that access can be gained to the air duct and said at least one flame-effect generator.

16. Heating apparatus according to claim 1, wherein the light source comprises a light bulb together with a fining therefor, mounted on a removable portion of the housing, such that said portion may be removed in order to replace the light bulb.

17. Heating apparatus according to claim 1, wherein the viewing screen has a forward-facing surface which is generally non-reflective.

18. Heating apparatus according to claim 1, wherein the viewing screen has a rearwardly-directed surface which is generally light-diffusing.

* * * * *

UNITED STATES PATENT AND TRADEMARK OFFICE

CERTIFICATE OF CORRECTION

PATENT NO. : 6,799,727 B2 
DATED : October 5, 2004
INVENTOR(S) : Gary Stanton Webster and Jeremy James Stanley It is certified that error appears in the above-identified patent and that said Letters Patent is hereby corrected as shown below:

Column 6,
Line 56, “fining” should be -- fitting --

Signed and Sealed this

Twenty-third Day of November, 2004

JON W. DUDAS
*Director of the United States Patent and Trademark Office*